United States Patent [19]

Udell

[11] Patent Number: 5,050,243

[45] Date of Patent: Sep. 24, 1991

[54] HOSPITAL GOWN

[76] Inventor: C. Leland Udell, 5 Collamer Cir., Shelburne, Vt. 05482

[21] Appl. No.: 638,106

[22] Filed: Jan. 7, 1991

Related U.S. Application Data

[63] Continuation of Ser. No. 604,929, Oct. 29, 1990.

[51] Int. Cl.[5] ..... A41D 13/12

[52] U.S. Cl. ..... 2/114; 2/52; 2/DIG. 7

[58] Field of Search ..... 2/52, 69, 75, 80, 105, 2/106, 114, DIG. 7

[56] References Cited

U.S. PATENT DOCUMENTS

| | | | |
|---|---|---|---|
| 2,425,402 | 8/1947 | Sieloff | 2/75 |
| 2,528,340 | 10/1950 | Coven | 2/114 |
| 2,533,039 | 12/1950 | Peitzman et al. | 2/75 |
| 2,807,022 | 9/1957 | Bonanni | 2/114 |
| 3,011,172 | 12/1961 | Tames | 2/114 |
| 3,349,285 | 10/1967 | Belkin . | |
| 3,490,072 | 1/1970 | Keltner . | |
| 3,977,025 | 8/1976 | Horan . | |
| 4,019,207 | 4/1977 | Newman et al. . | |
| 4,106,120 | 8/1978 | Zurbrigg et al. . | |
| 4,253,197 | 3/1981 | Posta . | |
| 4,422,186 | 12/1983 | Loney . | |
| 4,535,481 | 8/1985 | Ruth-Larson | 2/114 |
| 4,570,268 | 2/1986 | Freeman . | |
| 4,622,699 | 11/1986 | Spriggs . | |
| 4,679,256 | 7/1987 | Hischke | 2/105 |
| 4,787,101 | 11/1988 | Feinberg . | |

FOREIGN PATENT DOCUMENTS

| | | | |
|---|---|---|---|
| 4974 | of 1892 | United Kingdom | 2/80 |

*Primary Examiner*—Werner H. Schroeder
*Assistant Examiner*—Jeanette E. Chapman
*Attorney, Agent, or Firm*—Fish & Richardson

[57] ABSTRACT

A hospital gown has a body made of flexible material, with the edges defining a neckline and a hemline, and the body including panels of width sufficient to span the region of a patient's body between intersections of its coronal plane. The gown has arm openings adjacent the neckline, and two pairs of securing ties. One of the first pair of ties has a base end attached to the outside surface of the gown and the other tie is attached at the edge of the gown and has a free end. The body of the gown defines an opening adjacent the base end of the first tie and the free end of the other tie is adapted to extend through the opening for fastening together of the first pair of ties. The second pair of securing ties are attached to the outside surface and edge of the gown, respectively.

6 Claims, 4 Drawing Sheets

HOSPITAL GOWN

This application is a continuation in part of U.S. Ser. No. 07/604,929, filed Oct. 29, 1990.

BACKGROUND OF THE INVENTION

The invention relates to hospital gowns such as those provided to patients during hospital stays and during routine doctor office checkups.

Hospital gowns are well known for providing wearers with a mere modicum of personal modesty and warmth. A typical gown is made from a single panel of cloth having armhole openings, which may or may not have sewn-in sleeves, and two rear flaps which meet and are tied behind the wearer with little or no overlap. Since such a gown is usually made according to a one-size-fits-all standard, the rear flaps have a tendency to split apart, exposing the wearer to potential embarrassment and cold drafts. In addition, since it is often difficult for the wearer to reach behind himself and securely tie off the flaps, the flaps often come untied altogether, leaving the gown open in back. Some wearers combat this problem by wearing two gowns, the first gown tied in back and the second gown, worn over the first, tied in front, thereby creating inventory and cost problems for hospitals which must stock and clean twice as many gowns.

As a result of the costs necessarily incurred for stocking and cleaning reusable gowns, a recent trend toward providing patients with disposable gowns during routine checkups has produced a paper robe-like garment having front flaps which wrap around the wearer. To secure the flaps, paper ties are glued to either side of the robe at waist level, the loose ends of which the wearer can knot together in front of him. These ties, however, are difficult to twist and knot and often rip off the gown altogether. Furthermore, the material of such disposable gowns is often uncomfortable and scratchy.

SUMMARY OF THE INVENTION

In general, the invention features a hospital gown having a body made of flexible material, the edges of which define a neckline and a hemline, and the body of which includes panel portions of width sufficient to span the region of a patient's body between intersections of its coronal plane; the gown further includes arm openings adjacent the neckline, a pair of first securing members, one first securing member having a base end attached to the outside surface of the body portion which defines an opening adjacent the base end, and the other first securing member being attached at the edge of the first side body panel portion and having a free end adapted to pass through the opening, the pair of first securing members adapted for securement to one another; and a pair of second securing members, one second securing member being attached to the outside surface of the body portion and the other second securing member being attached at the edge of the second side body panel portion, the pair of second securing members adapted for securement to one another; the first securing members and the second securing members comprising ties.

In preferred embodiments, the gown further comprises tactile indicator means attached to the outside surface of the body at least adjacent to the base end of the first securing member. A plane of the first pairs of securing members is located generally above a plane of the second pair of securing members. The gown has a latitudinal edge portion and a diagonal edge portion so that the gown forms a V or scoop neck or back when worn. The securing members are color coded. Raglan sleeves are attached to the arm openings. And, finally, the body includes two side panel portions and one center panel portion which are separate elements joined together at seams, the securing members being attached at the seams.

The hospital gown of the present invention offers a number of advantages for the patient, including more modesty, as the gown wraps fully about the body, thereby reducing the possibility of suffering from embarrassment and cold drafts. The gown of the invention may also be donned by the patient and simply secured or re-secured, in most cases without assistance, using the ties placed for easy access at the sides of the body. The neckline is scooped, allowing the gown to be worn with the center panel at the front or the back as desired, and the gown may also be used to cover a patient where the patient is substantially immobile.

Other features and advantages of the invention will be apparent from the following description of a presently preferred embodiment, and from the claims.

DESCRIPTION OF A PRESENTLY PREFERRED EMBODIMENT

Figure 1:
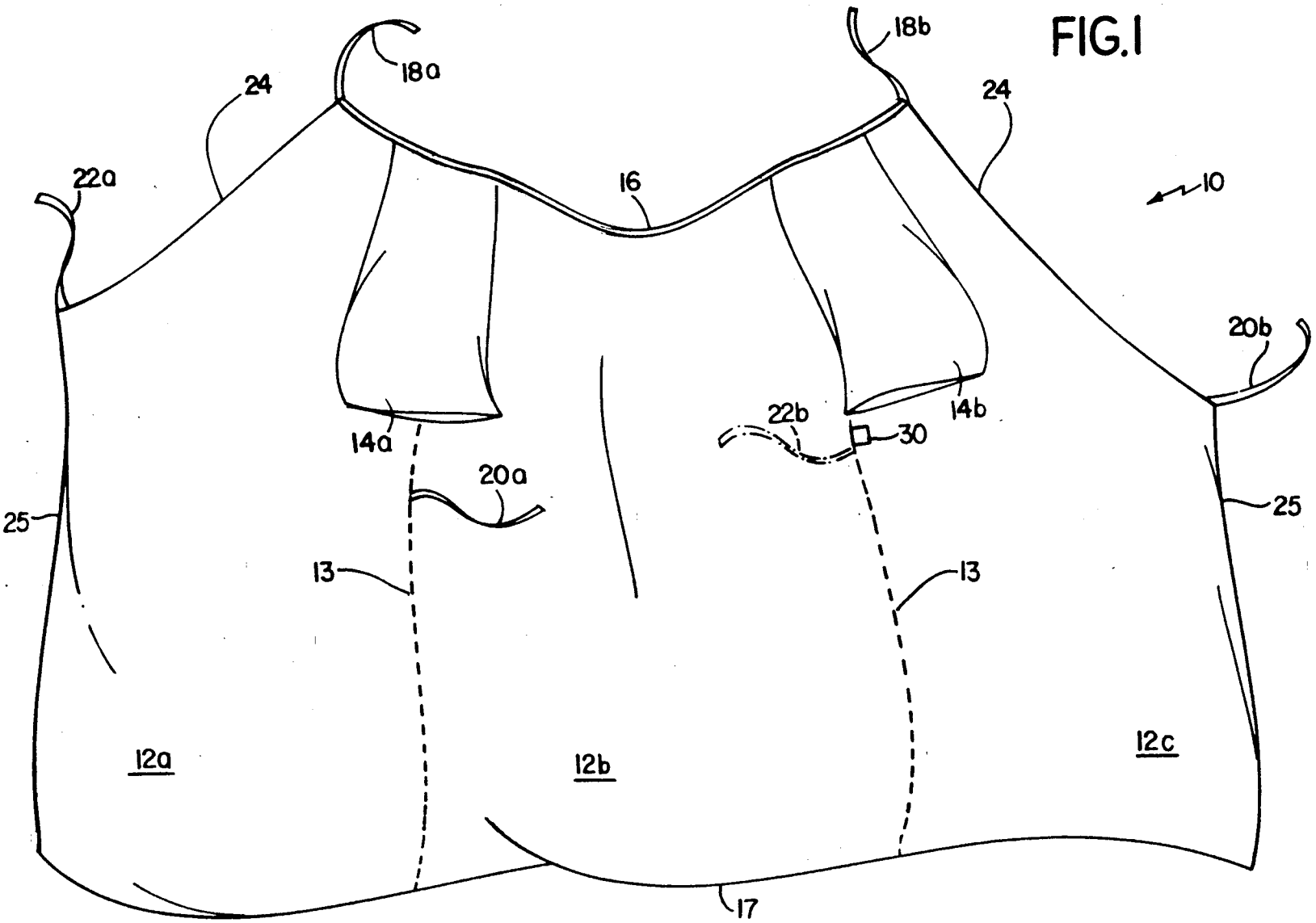
FIG. 1 is a front perspective view of a hospital gown of the present invention.

Referring to FIG. 1, a hospital gown 10 of the invention has a body 12 typically consisting of three body panel portions 12*a*, 12*b*, 12*c*. Two raglan sleeves 14*a*, 14*b* are sewn into openings in the body 12, a first longitudinal edge defining a neckline 16 is sewn across the top of the body portion 12, and a second longitudinal edge defines a hemline 17 across the bottom of the body portion 12. The panels 12*a*, 12*b*, 12*c*, sleeves 14, and neckline 16 are preferably made from sturdy, yet comfortable cloth, e.g., cotton sheeting, which can be washed and used again repeatedly. The dimensions of the gown depend, of course, entirely upon the size of the wearer, and typically a range of standard sizes (e.g., XS, S, M, L, XL for adults) will be provided. The side panels 12*a* and 12*c* and center panel 12*b* are equal in width and length, e.g., sufficient to span the front and back or intersections of a coronal plane of the typical wearer, i.e., the lengthwise plane which runs from side to side and divides the body into anterior and posterior portions. The gown is further sized to extend generally between the wearer's shoulders and knees. A diagonal edge 24 in each side body panel 12*a*, 12*c* extends from the end of the neckline 16 to approximately the middle of the panel, and a latitudinal edge 25 extends from the middle of the panel to the hemline 17, providing a V or scoop neck or back to the gown (FIG. 3). In an important aspect of the present invention, the side panels 12*a* and 12*c* are approximately twice as wide as those found in previous gowns, thereby allowing a wearer to wrap the gown about himself fully, as described below in connection with FIGS. 2 and 3.

Referring again to FIG. 1, the gown 10 further includes a number of ties for closing and securing the gown out the wearer. Neckline ties 18*a*, 18*b* extend from each end of the neckline 16. Corresponding waist ties 20*a*, 20*b* are sewn to the body 12 at waist level and into the outer edge of the panel 12*c*, respectively. Also, corresponding waist ties 22*a*, 22*b* (shown in dotted line) are sewn slightly above waist level into the outer edge of the panel 12*a* and into the body 12, respectively. For reasons described below in connection with FIGS. 2 and 3, the waist tie 22*b* is sewn on the inside of the gown 10, and a tactile indicator 30 is affixed to the outside surface of the gown at least adjacent the point where tie 22*b* is attached at the inside surface.

Figure 2:
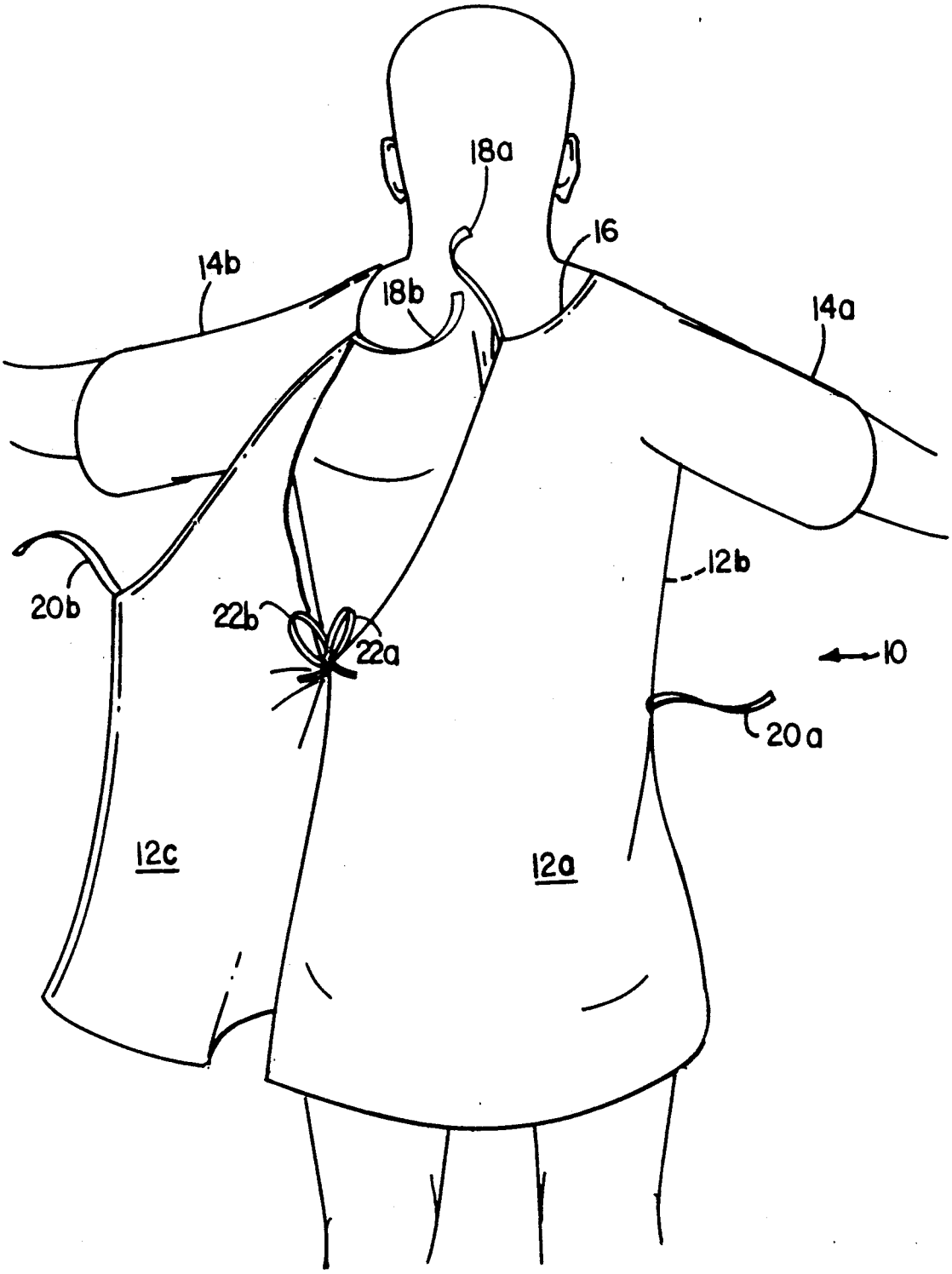
FIG. 2 is a somewhat diagrammatic rear view of a patient donning a hospital gown of the invention.
Figure 3:
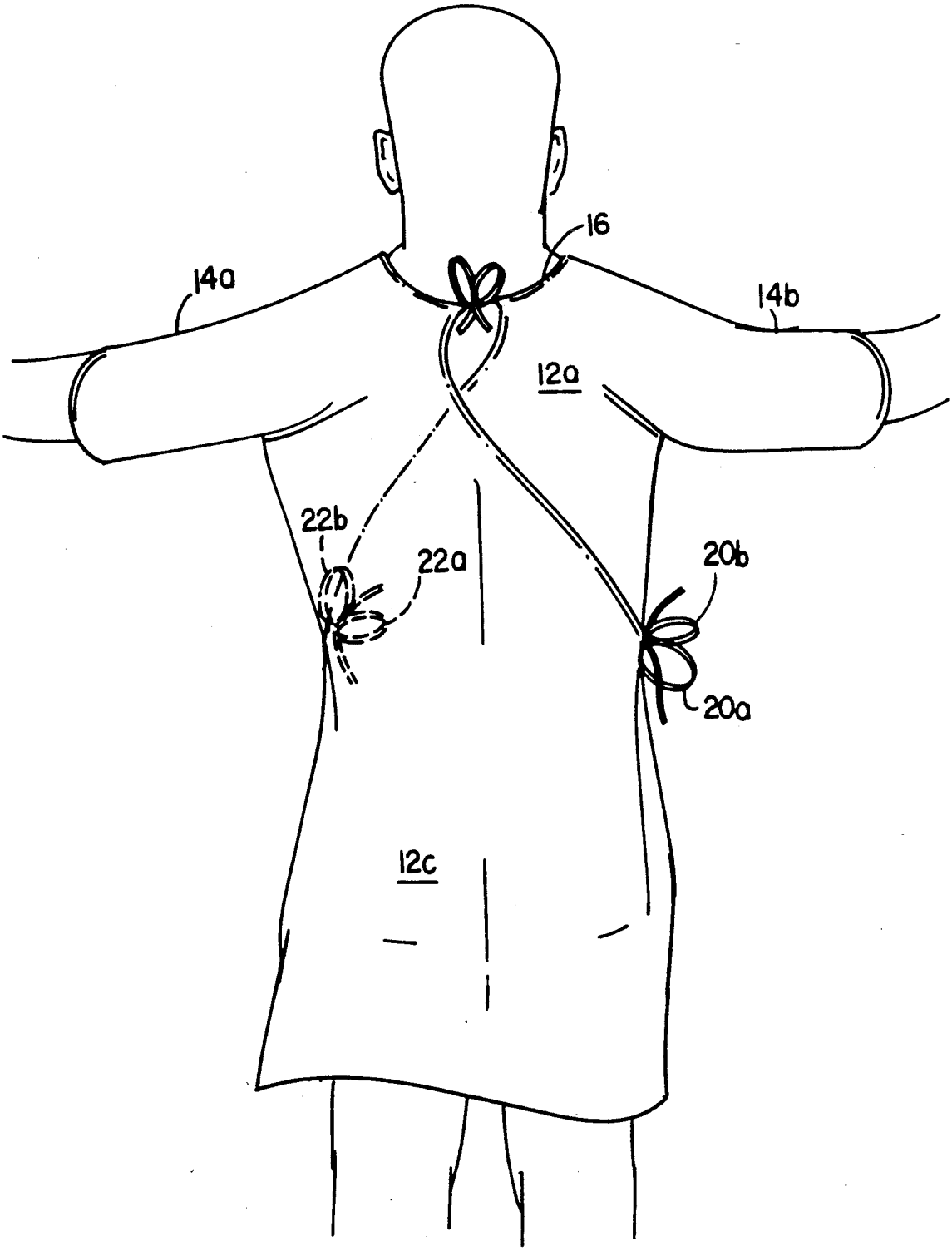
FIG. 3 is a similar view of a patient wearing the hospital gown.

Referring now also to FIGS. 2 and 3, the gown 10 of the invention is typically worn in the manner of present hospital gowns. That is, the patient places his or her arms through the sleeves 14 with the center body panel 12*b* covering the front of the body. To aid the patient in locating waist tie 22*b* within the gown, a medallion, emblem or other tactile indicator 30 is attached to the outer surface of the gown at least adjacent to the point of attachment of tie 22*b*. To further aid the wearer, the ties 22*a*, 22*b* are preferably made of the same color cloth and their positions on the seam and edge of the panels make them easy to locate. The patient ties waist ties 22*a*, 22*b* together and next pulls the panel 12*c* across his body, ties waist ties 20*a*, 20*b* together, and ties neckline ties 18*a*, 18*b* together to finish dressing himself in the gown. To further aid the wearer in this last step, the ties 20*a*, 20*b* are also preferably made of a color cloth that is different from the color of ties 22*a*, 22*b*, and ties 20*a*, 20*b* are positioned slightly below waist ties 22*a*, 22*b* to make them easy to locate.

The gown 10 of the invention has the advantages of the wider side body panels that overlap, thereby providing a greater level of modesty for the patient. Also, due to the greater width of the side panels, the ties are disposed at positions adjacent to the patient's sides where they can be more easily reached by the patient, e.g. for donning or removing the gown or simply tightening or re-securing the ties.

Alternatively, the gown 10 of the invention may also be worn much like a typical robe, i.e., with the center body panel 12*b* at the back and the side body panels 12*a*, 12*c* overlapping across the front of the patient. To wear the gown in this manner, the patient puts his arms through the sleeves 14, pulls panel 12*a* across his body, locates waist tie 22*b* inside the gown, and ties waist ties 22*a*, 22*b* together. Again, the patient may locate the inside tie 22*b* by simply feeling for the indicator 30 at the side region of the gown. The second side body panel 12*c* is then passed across the front of the patient and secured in place by engagement of corresponding ties 20*a*, 20*b*, the tie 20*a* disposed on the outer surface of the gown.

Figure 4:
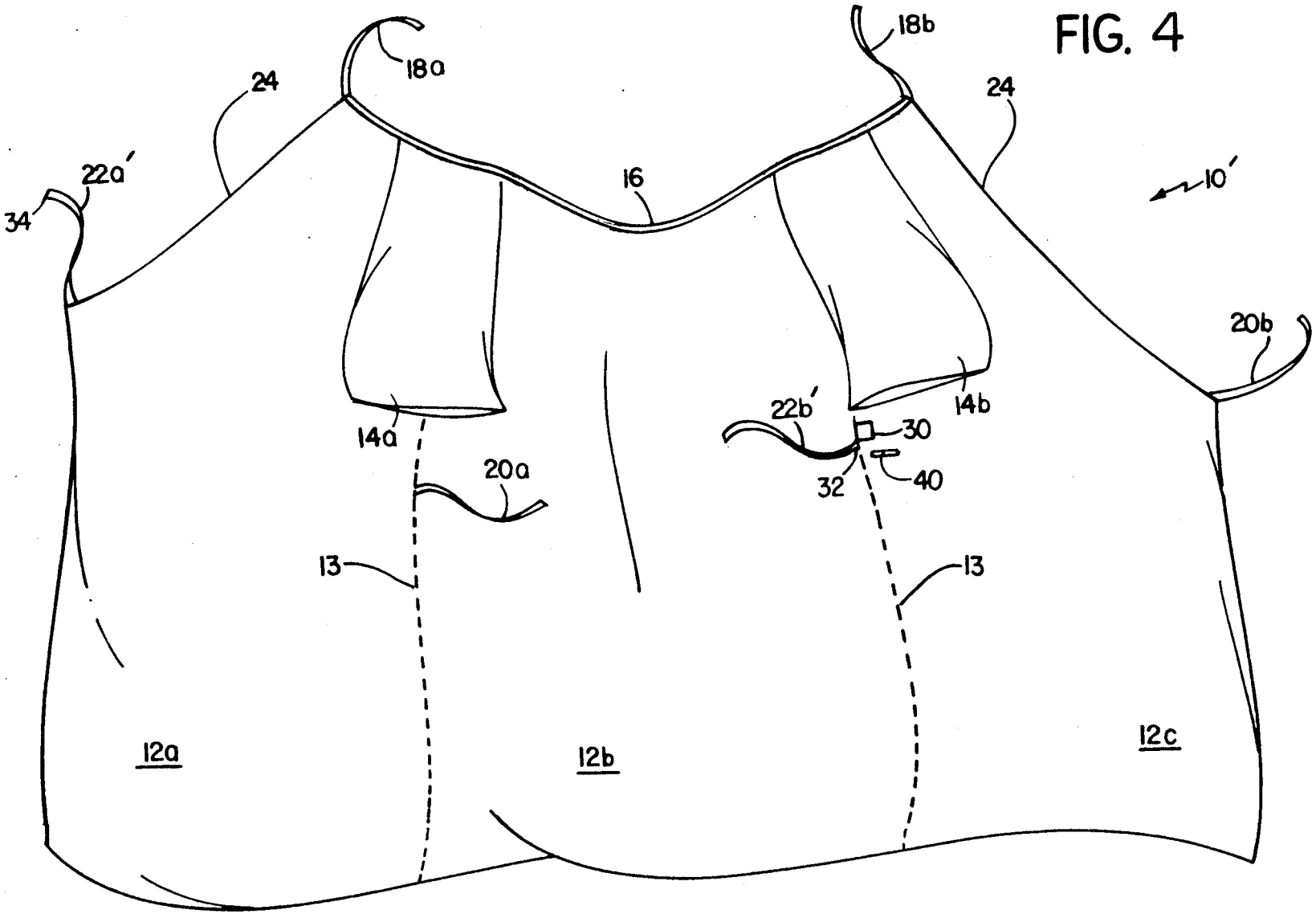
FIG. 4 is a front perspective view of another embodiment of a hospital gown of the present invention.

In another embodiment of the invention (shown in FIG. 4), the waist tie 22*b*′ is attached upon the outside surface of the gown and there is an opening 40, e.g. in the form of an elongated button hole, defined through the body of the gown adjacent the base 32 of the waist tie 22*b*′. The wearer places his or her arms through the sleeves 14, with the center panel 12*b* either to the front or to the back, and draws the side panel 12*a* across the body. The free end 34 of waist tie 22*a*′ at the perimeter is fed through the opening 40 and tied with waist tie 22*b*′ on the outside surface of the gown at the wearer's side. The second side panel 12*c* is then drawn across the body, overlapping panel 12*a*, and the perimeter waist tie 20*b* is tied with the waist tie 20*a* at the wearer's opposite side.

Thus, the present invention provides a substantially more modest and fully wrapped gown than previously available, thereby reducing the possibility that a patient will suffer embarrassment and cold drafts. The gown of the invention also offers an advantage in more severe situations where a patient is substantially immobile, as a nurse may simply lay a hospital gown across the patient, i.e., the gown 10 of the invention offers increased modesty due to the increased width, allowing the side panels to be tucked beneath the patient, without securing the ties.

In the embodiment shown, the body 12 of gown 10 is formed of a single sheet of material. In another embodiment, the three body panels 12*a*, 12*b*, 12*c* may be provided as separate elements and sewn together at two seams (suggested by dashed lines 13 in FIG. 1), with the ties 20*a* and 22*b* sewn into the seams. This arrangement will provide for more secure attachment of the ties 20*a*, 22*b* to the body 12, thus reducing the cost for maintenance of a gown during its term of use.

Other embodiments are within the following claims. For example, hook-and-loop type fasteners or button closures may be provided instead of ties for patients lacking the ability to securely knot the ties.

What is claimed is:

1. A gown for wear by a patient in a hospital and the like, comprising:

a body portion of flexible material having an inside surface and an outside surface, a first longitudinal edge defining a neckline and a second longitudinal edge defining a hemline, said body portion having a center body panel portion and first and second side body panel portions extending from said center body panel portion, each said body panel portion being of width at least sufficient to span a region of the patient's body between intersections of a coronal plane of the patient's body, said first and second side body panel portions each defining a side edge extending generally between said neckline and said hemline;

a pair of arm openings defined in said body portion adjacent said neckline, said arm openings being spaced apart by a shoulder width and equidistant from ends of said neckline;

a pair of first securing members, one said first securing member having a base end attached to said outside surface of said body portion, said body portion defining an opening adjacent said base end, and the other said first securing member being attached at the edge of said first side body panel portion and having a free end adapted to pass through said opening, said pair of first securing members adapted for securement to one another;

a pair of second securing members, one said second securing member being attached to said outside surface of said body portion and the other said second securing member being attached at the edge of said second side body panel portion, said pair of second securing members adapted for securement to one another; and tactile indicator means attached to the outside surface of said body portion at least adjacent to said base end of said first securing member, said first securing members and said second securing members comprising ties.

2. The gown of claim 1 wherein a plane of said first pair of securing members is located generally above a plane of said second pair of securing members.

3. The gown of claim 1 wherein each said side edge comprises a latitudinal edge portion and a diagonal edge portion.

4. The gown of claim 1 wherein said first securing members are of a first colored material, and said second securing members are of a second colored material, said first and said second colored materials being different from one another.

5. The gown of claim 1 further comprising a pair of raglan sleeves attached to said openings.

6. The gown of claim 1 wherein said center body portion and said first and second side body panel portions are separate elements joined together at seams, a said first securing member attached to said outside surface of said body portion at a seam between said first side body panel portion and said center body panel portion, a said second securing member attached to said outside surface of said body portion at a seam between said second side body panel portion and said center body pane portion.

* * * * *